US010890935B2

(12) United States Patent
Mouret et al.

(10) Patent No.: US 10,890,935 B2
(45) Date of Patent: Jan. 12, 2021

(54) BANDGAP CURRENT ARCHITECTURE OPTIMIZED FOR SIZE AND ACCURACY

(71) Applicant: NXP USA, Inc., Austin, TX (US)

(72) Inventors: Guillaume Mouret, Toulouse (FR); Yann Cargouet, Toulouse (FR); Thierry Sicard, Haute Garonne (FR)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 16/282,847

(22) Filed: Feb. 22, 2019

(65) Prior Publication Data

US 2020/0233445 A1 Jul. 23, 2020

(30) Foreign Application Priority Data

Jan. 21, 2019 (EP) ..... 19305073

(51) Int. Cl.
*G05F 1/46* (2006.01)
*G05F 3/26* (2006.01)

(52) U.S. Cl.
CPC ..... *G05F 3/267* (2013.01); *G05F 1/462* (2013.01); *G05F 1/46* (2013.01)

(58) Field of Classification Search
CPC . G05F 3/267; G05F 1/46; G05F 1/462; G05F 3/30; G05F 3/26; G05F 3/262; G05F 3/265
See application file for complete search history.

(56) References Cited

U.S. PATENT DOCUMENTS

| | | | | |
|---|---|---|---|---|
| 5,349,286 | A | 9/1994 | Marshall et al. | |
| 6,057,727 | A * | 5/2000 | Dautriche | G05F 3/262 323/313 |
| 6,181,121 | B1 * | 1/2001 | Kirkland | G05F 3/262 323/313 |
| 8,913,050 | B2 * | 12/2014 | Shishido | G01J 1/0209 345/207 |
| 2007/0052480 | A1 * | 3/2007 | Pastorina | G05F 3/262 330/288 |
| 2008/0042737 | A1 | 2/2008 | Kim et al. | |
| 2008/0048634 | A1 * | 2/2008 | Kotchkine | G05F 3/30 323/313 |
| 2009/0251203 | A1 | 10/2009 | Kimura | |
| 2010/0308788 | A1 | 12/2010 | Sicard | |
| 2013/0328615 | A1 * | 12/2013 | Sano | G05F 3/30 327/513 |
| 2014/0077789 | A1 | 3/2014 | Hu et al. | |
| 2017/0147028 | A1 | 5/2017 | Arnold et al. | |
| 2020/0081475 | A1 * | 3/2020 | Marinca | G05F 3/20 |

* cited by examiner

*Primary Examiner* — Thienvu V Tran
*Assistant Examiner* — Shahzeb K Ahmad

(57) ABSTRACT

A low voltage bandgap reference circuit (200) is provided which includes a first current generator (202) having first and second circuit branches which include, respectively, first and second bipolar transistors having different sizing reference values for generating a first current at a first resistor that varies proportionally as a function of temperature; a second current generator (204, 205) having a third circuit branch which includes one or more field effect transistors and no bipolar transistors for generating a second current that varies inversely as a function of temperature; and a third circuit (206) connected to generate a bandgap reference current in response to the first current and the second current.

10 Claims, 5 Drawing Sheets

300

400

501

502

503

600

BANDGAP CURRENT ARCHITECTURE OPTIMIZED FOR SIZE AND ACCURACY

BACKGROUND OF THE INVENTION

Field of the Invention

The present invention is directed in general to bandgap reference circuits. In one aspect, the present invention relates to a low voltage bandgap reference circuits for generating a voltage or current reference that may use a BiCMOS process.

Description of the Related Art

Bandgap reference circuits are used to develop a constant reference voltage or reference current. Conventional bandgap reference circuits use an operational amplifier which is configured to force its inputs to be equal, thereby causing currents to be equal or to cause certain voltages to be equal. Conventional bandgap reference circuits may generate a bandgap voltage and then translate the bandgap voltage into a current. For example, existing bandgap reference circuits will typically combine a first current that is a proportional to absolute temperature (PTAT) and a second current that is inversely or complementary to absolute temperature (CTAT) to form a reference or bias current that is applied to an output resistor to generate the reference voltage. The most popular bandgap circuits employ a Brokaw, Widlar, or Kuijk topology which compensate the CTAT voltage ($V_{BE}$) developed across the base-emitter voltage of a bipolar transistor by a factor K (close to 10) multiplied by the PTAT voltage ($\Delta V_{BE}$) to give a temperature-independent voltage reference that is close to 1.2V (gap voltage of silicon). In addition, there are sub-bandgap reference circuits that compensate the PTAT voltage ($\Delta V_{BE}$) by a ratio of the CTAT voltage ($V_{BE}$) to provide a sub-bandgap voltage of 120 mV that could be amplified to generate higher voltage. For example, FIG. 1 illustrates one conventional bandgap voltage circuit which includes a first BiCMOS circuit for generating a PTAT current, a second BiCMOS circuit for generating a CTAT current, and a third circuit for generating a bias current by summing the CTAT current and PTAT current. However, the implementation of such conventional bandgap voltage circuits require large numbers of circuit components, including bipolar transistors which can contribute errors to the generated reference current. As seen from the foregoing, the existing bandgap reference circuit solutions are extremely difficult at a practical level by virtue of the challenges with generating accurate bandgap reference currents and voltages, especially as the number of circuit components add to the size, cost, errors, and circuit complexity.

BRIEF DESCRIPTION OF THE DRAWINGS

The present invention may be understood, and its numerous objects, features and advantages obtained, when the following detailed description of a preferred embodiment is considered in conjunction with the following drawings.

DETAILED DESCRIPTION

A low supply voltage BiCMOS self-biased bandgap reference architecture, circuit, system, architecture, and methodology are described for accurately generating a bandgap reference voltage and current having fewer components and error contributors. In selected embodiments, the bandgap reference architecture generates reference current and a 1V reference voltage (or smaller) using as few as two differently-sized bipolar transistors and eleven FET transistors arranged in only five current branches. In selected embodiments, the differently-sized bipolar transistors may include a first bipolar transistor having a sizing reference of m=1, and a second bipolar transistor having a sizing reference of m=8 which is constructed with a combination of 8 bipolar transistors having a sizing reference of m=1 connected in parallel, for a total of 9 bipolar transistors. The first and second current branches are connected, respectively, first and second bipolar transistors, to generate a first current that is a proportional to absolute temperature (PTAT) and a second current that is inversely or complementary to absolute temperature (CTAT). Without requiring an additional bipolar transistor or operational amplifier circuit, a third current branch creates a current mirror copy of the CTAT current which may be added with the PTAT current by an output branch summation circuit formed with the fourth and fifth current branches which are combined to generate the reference current ($i_{BIAS}$) and reference voltage (Vref) at an output node. By simultaneously generating the reference current ($i_{BIAS}$) and reference voltage (Vref) without using an additional bipolar transistor to generate the CTAT current, a smaller bandgap reference circuit is provided with improved accuracy and temperature independence. Additional improvements for the bandgap reference circuit are provided to remove base current contributions from the bipolar transistors to the generated reference current ($i_{BIAS}$), to generate a reference current ($i_{BIAS}$) with zero temperature coefficient (TC) variation, and/or to remove other error contributions to the reference current, thereby providing a bandgap reference circuit that does not require an operational amplifier which may limit headroom, that directly generates reference currents, that minimizes the need for extra circuitry to maintain stability in a feedback loop, that provides a simple modular design, that provides a PTAT current, an CTAT current, or combination of both currents as outputs, and/or that provides a low voltage operation (e.g., may operate at 1 volt or lower across all process corners).

Figure 1:
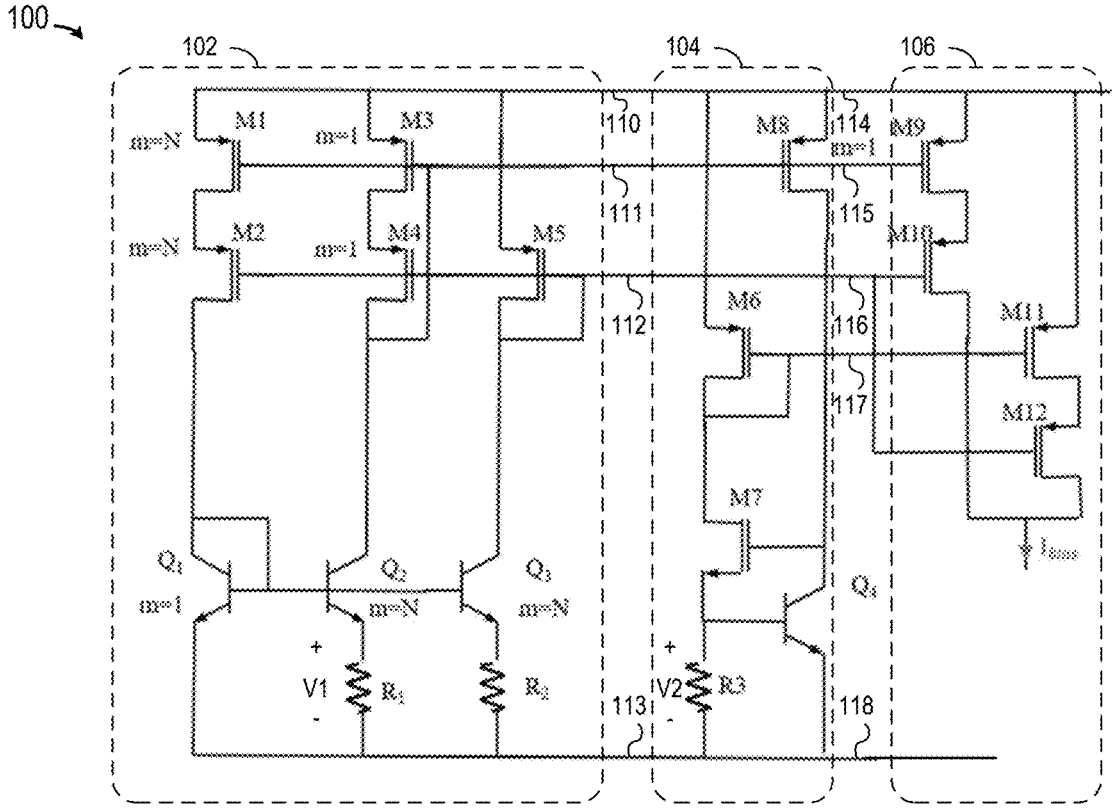
Figure 1 (Prior Art)
FIG. 1 is a schematic circuit depiction of a conventional bandgap reference circuit.

To provide additional details for an improved contextual understanding of the present disclosure, reference is now made to FIG. 1 which is a schematic circuit depiction of a conventional bandgap reference circuit 100 which includes a first current generator block (or circuit) 102, a second current generator block (or circuit) 104 and a third current summing block (or circuit) 106. The first circuit 102 includes FET transistors M1-M5, bipolar transistors Q1-Q3, and resistors R1-R2 connected as shown. The bipolar transistors Q1-Q3 may be implemented as bipolar-junction transistors and the FET transistors M1-M5 may be implemented as CMOS transistors. The first circuit 102 is connected to provide input/outputs 110-113 that are connected, respectively, to the second circuit 104.

The second circuit 104 includes FET transistors M6-M8, bipolar transistor Q4, and resistor R3 connected as shown to provide an input/outputs 114-118 that are connected, respectively, to the third circuit 106. The third circuit 106 includes FET transistors M9-M12 that are connected to generate the reference or bias current (Ibias).

The FET transistors M3, M4, M8 and bipolar transistor Q1 are shown having a sizing reference of m=1, while the FET transistors M1-M2, and bipolar transistors Q2-Q3 are shown with a sizing reference of m=N to indicate that the transistors M1, M2, Q2, and Q3 have a size that may be an integer (or integer fraction) multiple greater than the size of the transistors with the reference m=1. In an example embodiment, the transistors Q2 and Q3 may be four times the size of the transistor Q1. However, other multiples may be implemented accordingly to meet the design criteria of a particular implementation.

In operation, the first circuit 102 may develop a first voltage (e.g., V1) based on the voltage difference of the base-emitter junctions of the transistors Q1 and Q2, which are generally biased at different current densities due to their different sizes. The first voltage V1 may be impressed across the resistor R1 (and/or R2) to generate a PTAT current (e.g., I1) that is proportional to temperature changes. The PTAT current I1 may be defined by the equation I1=(Vbe1−Vbe2)/R1.

The second circuit 104 may develop a second voltage (e.g., V2) based on the base-emitter junction voltage of the transistor Q4 which may be inversely proportional to temperature. The second voltage V2 may be impressed upon the resistor R3 to develop a CTAT current (e.g., I2) that is inversely proportional to temperature. The CTAT current I2 may be defined by the equation I2=Vbe4/R3.

At the third circuit 106, the currents I1 and I2 may be summed (i.e., added) together to generate an output current (e.g., Ibias) which is defined by the equation Ibias=I1+I2=(Vbe1−Vbe2)/R1+Vbe4/R3. By summing the PTAT current I1 and CTAT current I2, the third circuit 106 generates a current that is substantially independent of temperature since it is the addition of a PTAT and a CTAT current leading to a current flat over temperature. If the current Ibias flows through an external resistor Rext (not shown) of the same type as the resistors R1, R2 and R3, a reference voltage across the resistor Rext may be generated.

While the bandgap reference circuit 100 generates a reference current Ibias that is substantially constant with respect to process, voltage or temperature changes, it includes circuit components that contribute to the overall circuit size and that introduce potential errors in the generated output current Ibias. For example, the second circuit 104 for generating the CTAT current includes a bipolar transistor Q4 that increases the die size of the bandgap reference circuit, thereby adding to the component costs and manufacturing complexity. Another problem created by the bipolar transistor Q4 in the CTAT generator circuit 104 is the potential mismatch between the bipolar transistor Q4 in the CTAT generator circuit 104 and the bipolar transistors Q1, Q2 in the PTAT generator circuit 102. In addition, any mismatch between the transistors M3 and M8 can create an error on the generated CTAT current I2 since, by changing the current flowing into the collector of Q4, this leads to an error on the base-emitter voltage $V_{BEQ4}$ generated by Q4 so that the CTAT current that is generated is equal to $I_{CTAT}=V_{BEQ4}/R3$.

Figure 2:
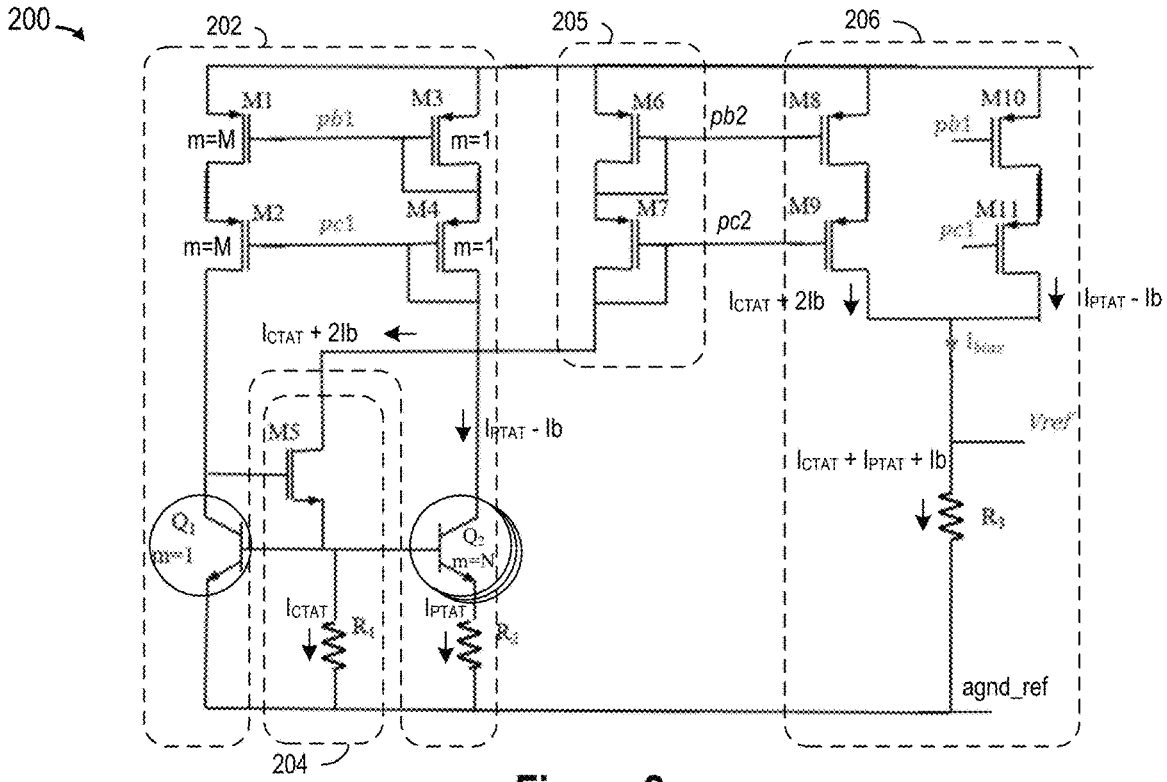
FIG. 2 is a schematic circuit depiction of a first bandgap reference circuit in accordance with selected embodiments of the present disclosure.

To address these limitations and others from the conventional bandgap reference circuits that will be known to those skilled in the art in light of the present disclosure, reference is now made to FIG. 2 which is a schematic circuit depiction of a first bandgap reference circuit 200 which includes a first current generator block (or circuit) 202, a second current generator block (or circuit) 204, a third current mirror block (or circuit) 205, and a fourth current summing block (or circuit) 206. The first circuit 202 includes FET transistors M1-M4, bipolar transistors Q1-Q2, and resistor R2 connected as shown to generate a first PTAT current across the resistor R2. The second circuit 204 includes FET transistor M5 and resistor R1 connected as shown to generate a second CTAT current across the resistor R1. As connected, the first and second circuits 202, 204 form a first circuit branch M1/M2/Q1 and a second circuit branch M3/M4/Q2/R2. The third circuit 205 includes FET transistors M6-M7 connected as part of a third circuit branch M6/M7/M5/R1, where the current coming from M5 is flowing into M6 and M7 and generates biasing voltage pb2/pc2 on their gates. As depicted, the FET transistors M6-M7 form a current mirror at the drain of the FET transistor M5 in order to source a CTAT current to the output branch summation circuit 206 which includes fourth circuit branch M8/M9 and fifth circuit branch M10/M11, where the transistors M8 and M9 are connected as current recopy of current flowing into M6/M7, and where the transistors M10 and M11 are connected as current recopy of current flowing into M3/M4. As depicted, the output branch summation circuit 206 combines the currents from the fourth and fifth circuit branches M8/M9, M10/M11 to generate the reference current (Ibias) and reference voltage (Vref) at an output node.

The bipolar transistors Q1-Q2 may be implemented as bipolar-junction transistors and the FET transistors M1-M11 may be implemented as CMOS transistors. In addition, the FET transistors M3, M4 are shown having a sizing reference of m=1, while the FET transistors M1-M2 are shown with a sizing reference of m=M to indicate that the transistors M1, M2, have a size that may be an integer (or integer fraction) multiple M greater than the size of the M3, M4 transistors. Likewise, the bipolar transistor Q1 is shown having a sizing reference of m=1, while the bipolar transistor Q2 is shown with a sizing reference of m=N to indicate that the bipolar transistor Q2 has a size that may be an integer (or integer fraction) multiple N greater than the size of the Q1 transistor.

In contrast to conventional bandgap reference circuits, the bandgap reference circuit 200 does not include an additional bipolar transistor in the CTAT current generator/mirror circuits 204, 205, but instead uses the bipolar transistor Q1 to generate the CTAT current through the resistor R1. In particular, CTAT current is generated with the third circuit branch M6/M7/M5/R1 which connects the first resistor R1 across the base-emitter voltage $V_{BEQ1}$ of bipolar transistor Q1 that is used to generate the base-emitter voltage differential $\Delta VBE=V_{BEQ1}-V_{BEQ2}$. As the base-emitter voltage $V_{BEQ1}$ is inverse or complementary to absolute temperature (CTAT) by virtue of decreasing by almost 2 mV/degree, the current flowing into the first resistor R1 is a CTAT current. Upon assuming that the first order temperature variation (TC1) of the first resistor R1 is negligible, then the FET transistor M5 connected between the collector and base of bipolar transistor Q1 provides the CTAT current into the first resistor R1 under a first analysis that base currents Ib1, Ib2 of bipolar transistors Q1 and Q2 are negligible. Under this analysis, the connection of the CTAT current mirror circuit 205 on the drain of the FET transistor M5 effectively sources the CTAT current to other branches, including the output branch summation circuit 206 that generates the bandgap voltage reference Vref. As a result of adding the FET transistor M5 in the third circuit branch, the bandgap reference circuit 200 is optimized for size and accuracy since it does not use additional bipolar transistors (e.g., Q4 in FIG. 1) in the CTAT generator circuit, thereby reducing the die size. In addition, the elimination of the additional bipolar transistor provides a more accurate CTAT current by eliminating potential error contributions from transistor mismatch between the FET transistors M3 and M8 that can create error on the CTAT current by changing the current flowing into the collector of bipolar transistor Q4 (as shown in FIG. 1) which leads to an error on the base-emitter voltage generated by the bipolar transistor Q4 ($V_{BEQ4}$). Yet another advantage is that the bandgap reference circuit 200 can generate smaller and more accurate bandgap reference voltages. In particular, upon assuming that the base currents Ib1, Ib2 of bipolar transistors Q1 and Q2 are negligible, the output reference voltage Vref of the bandgap reference circuit 200 is equal to:

$$Vout=Ibias*R3=(I_{CTAT}+I_{PTAT})*R3=(V_{BEQ1}/R1+\Delta V_{BE}/R2)*R3.$$

Figure 3:
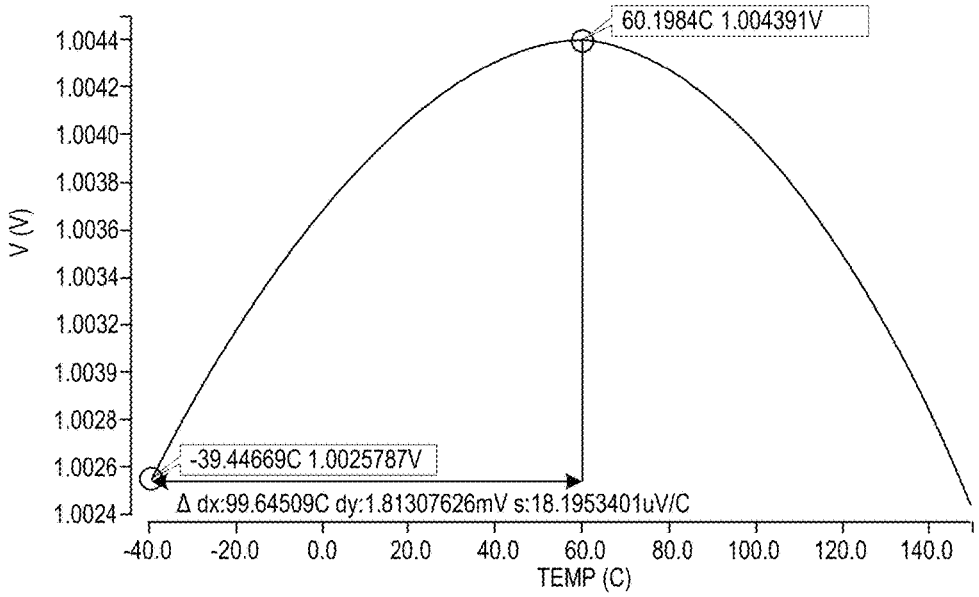
FIG. 3 is a diagram of an output voltage as a function of temperature in the band gap reference voltage circuit of FIG. 2.

To provide additional details for an improved understanding of selected embodiments of the present disclosure, reference is now made to FIG. 3 which depicts a diagram 300 of an output voltage as a function of temperature in the bandgap reference voltage circuit 200 of FIG. 2. In particular, the simulated curve 300 demonstrates a typical case from −40° C. to +150° C. to show that bandgap reference voltage circuit 200 can be used to generate a voltage reference close to 1V with a traditional parabolic curvature of +/−0.9 mV.

Figure 4:
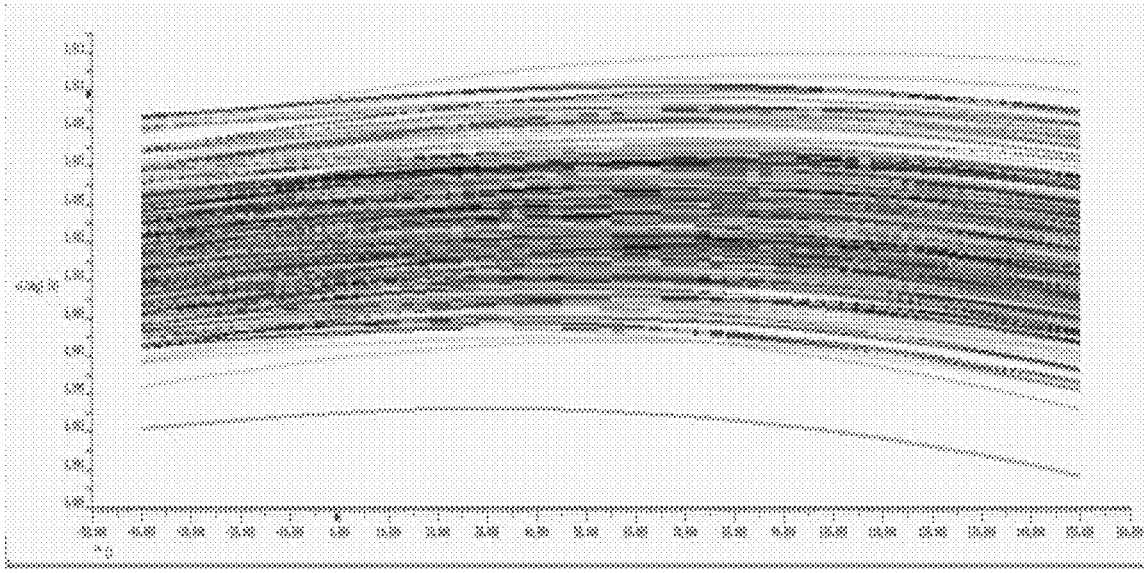
FIG. 4 depicts a Monte Carlo simulation of the bandgap reference voltage over temperature in the band gap reference voltage circuit of FIG. 2.

To provide additional details for an improved understanding of selected embodiments of the present disclosure, reference is now made to FIG. 4 which depicts a Monte Carlo simulation 400 of the bandgap reference voltage over temperature generated by the bandgap reference voltage circuit 200 of FIG. 2. In particular, FIG. 4 shows the simulation of the bandgap voltage reference over process and mismatch variation on 300 runs (Monte Carlo simulation) over the temperature range from −40° C. to +150° C. to show that bandgap reference voltage circuit 200 can be used to generate voltage references between approximately 0.995V to approximately 1.013V.

Figure 5A:
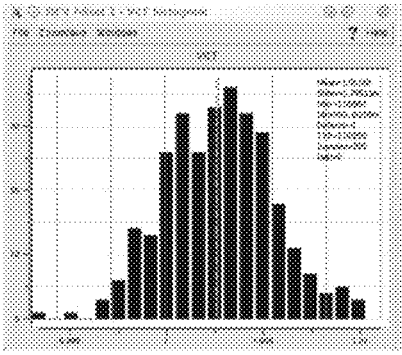
FIGS. 5*a-c* depict a gaussian distributions of the bandgap voltage reference at cold temperature, hot temperature, and temperature coefficient for the band gap reference voltage circuit of FIG. 2.
Figure 5B:
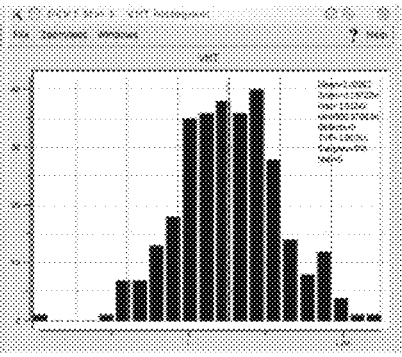
Figure 5C:
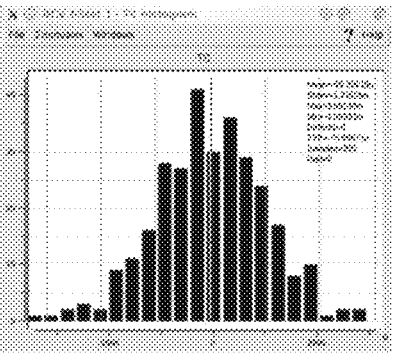

To provide additional details for an improved understanding of selected embodiments of the present disclosure, reference is now made to FIGS. 5*a-c* which depict gaussian distributions of the bandgap voltage reference at cold temperature, hot temperature, and temperature coefficient for the band gap reference voltage circuit 200 of FIG. 2. In particular, FIG. 5*a* shows the gaussian distribution 501 of the bandgap reference voltages at cold temperatures (CT of approximately −40° C.) and FIG. 5*b* shows the gaussian distribution 502 of the bandgap reference voltages at hot temperatures (HT of approximately +150° C.). In addition, FIG. 5*c* shows the gaussian distribution 503 of the bandgap reference voltages as a function of the temperature coefficient (TC) defined as TC=VHT−VCT. As shown in FIG. 5*b*, the standard deviation (σ) is higher at High temperature and is equal to σ=3.3 mV. As a result, the generated voltage reference has an accuracy of 2.1% at 6 σ without any trim which is good accuracy for the band gap reference voltage circuit 200 that requires a small number of components.

Figure 6:
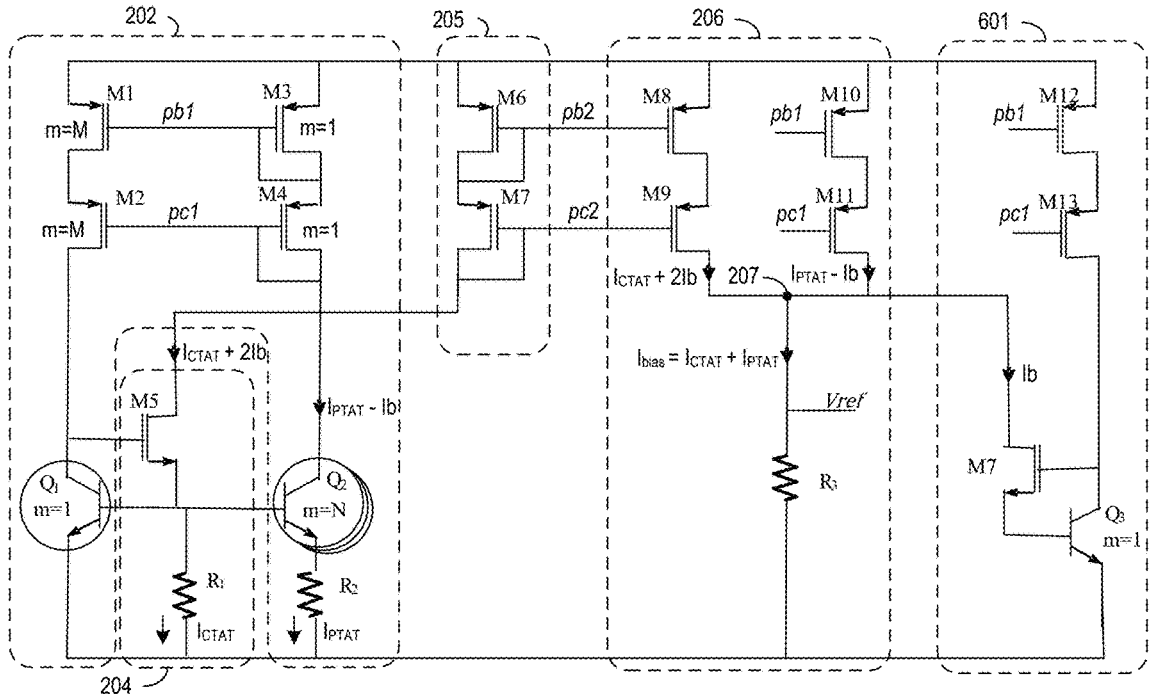
FIG. 6 is a schematic circuit depiction of a second bandgap reference circuit with a base current compensation circuit in accordance with selected embodiments of the present disclosure.

To further improve the accuracy of the bandgap reference voltage and current in light of the present disclosure, reference is now made to FIG. 6 which is a schematic circuit depiction of a second bandgap reference circuit 600 in accordance with an alternate embodiment to the present disclosure. In addition to the first current generator block (or circuit) 202, second current generator block (or circuit) 204, third current mirror block (or circuit) 205, and fourth current summing block (or circuit) 206 as shown in FIG. 2, the second bandgap reference circuit 600 adds a base current compensation block (or circuit) 601. As depicted, the base current compensation circuit 601 includes FET transistors M12-M13, M7, and bipolar transistor Q3 connected as shown to form a sixth current branch which removes the remnant base current Ib from the reference current (Ibias) that is generated by the fourth current summing block (or circuit) 206 as a result of the bipolar transistors Q1, Q2. In particular, FIG. 6 shows the current flow effects of non-negligible base currents Ib1, Ib2 of bipolar transistors Q1 and Q2, resulting in a first current flow in the second current branch ($I_{PTAT}-Ib2=I_{PTAT}-Ib$) and a second current flow in the third current branch ($I_{CTAT}+Ib1+Ib2=I_{CTAT}+2Ib$). Through the action of the output branch summation circuit 206, the first and second current flows are summed or combined to generate the output sum current at node 207 of $I_{CTAT}+I_{PTAT}+Ib$, with $Ib=I_{PTAT}/\beta$. If the remnant base current Ib is included in the reference current Ibias supplied to the output resistor R3, there can be significant errors in the reference voltage Vref since the β of a transistor can have wide variation over the process/mismatch, leading to an increased sigma for the output voltage reference Vref. To eliminate this error source, the base current compensation circuit 601 removes the base current Ib by including an additional bipolar transistor Q3 as part of the sixth current branch M12/M13/M7/Q3 so that the output voltage reference equals $Vref=R3*(I_{CTAT}+I_{PTAT})$. As seen from the foregoing, the base current compensation circuit 601 effectively provides cancellation or filtering of the first and second current flow from the fourth current summing block (or circuit) 206.

Figure 7:
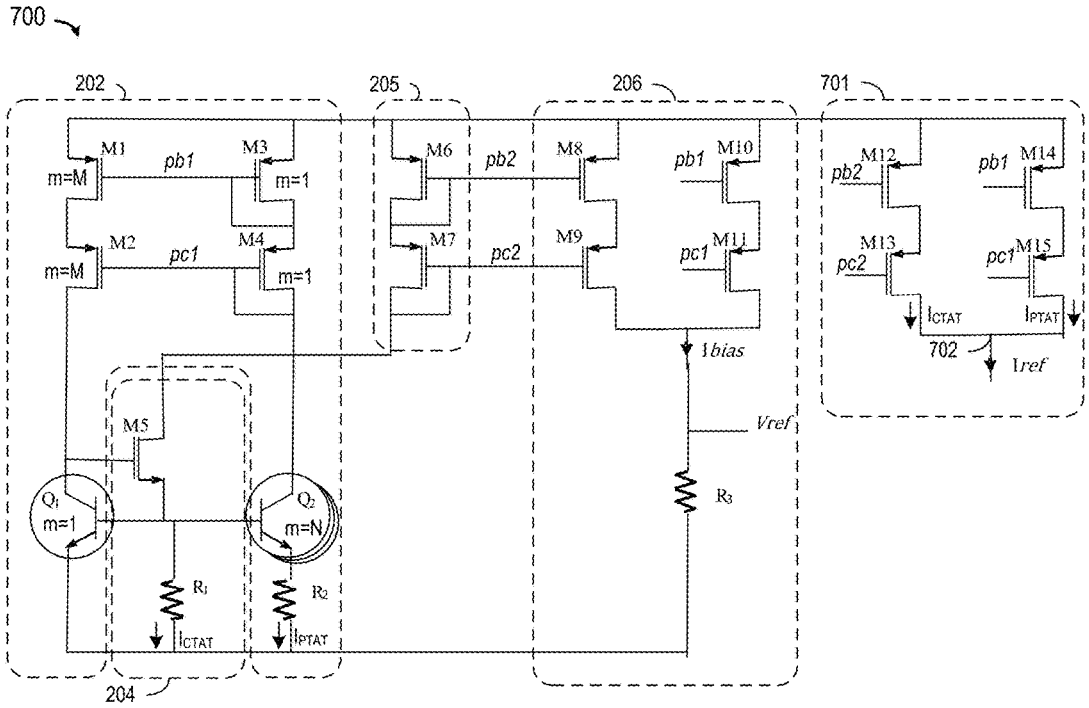
FIG. 7 is a schematic circuit depiction of a third bandgap reference circuit with a current reference having zero temperature coefficient variation in accordance with selected embodiments of the present disclosure.

To further improve the accuracy of the bandgap reference voltage and current in light of the present disclosure, reference is now made to FIG. 7 which is a schematic circuit depiction of a third bandgap reference circuit 700 having zero temperature coefficient variation in accordance with an alternate embodiment to the present disclosure. In addition to the first current generator block (or circuit) 202, second current generator block (or circuit) 204, third current mirror block (or circuit) 205, and fourth current summing block (or circuit) 206 as shown in FIG. 2, the third bandgap reference circuit 700 adds a current mirror block (or circuit) 701 for generating copies of the PTAT and CTAT currents. As depicted, the current mirror circuit 701 includes FET transistors M12-M15 connected as shown to form an additional current branch which creates a reference current (Iref) with zero temperature coefficient (TC) variation. In particular, the current mirror circuit 701 includes a first additional current branch in which FET transistors M12-M13 are connected in series, with the transistors M12 and M13 having gates controlled by the gate control signals pb2, pc2, respectively. In addition, the current mirror circuit 701 includes a second additional current branch in which FET transistors M14-M15 are connected in series, with the transistors M14 and M15 having gates controlled by the gate control signals pb1, pc1, respectively. In operation, the current flow effects in the third bandgap reference circuit 700 result in a first CTAT current flow ($I_{CTAT}$) in the first additional current branch transistors M12/M13 branch and a second PTAT current flow ($I_{PTAT}$) in the second additional current branch transistors M14/M15. Through the action of the current source circuit 701, the first and second current flows are summed or combined to generate the output sum current at node 702 of Iref=$I_{CTAT}$+$I_{PTAT}$ (if the base current Ib is negligible) or $I_{CTAT}$+$I_{PTAT}$+Ib (if the base current Ib is non-negligible).

Figure 8:
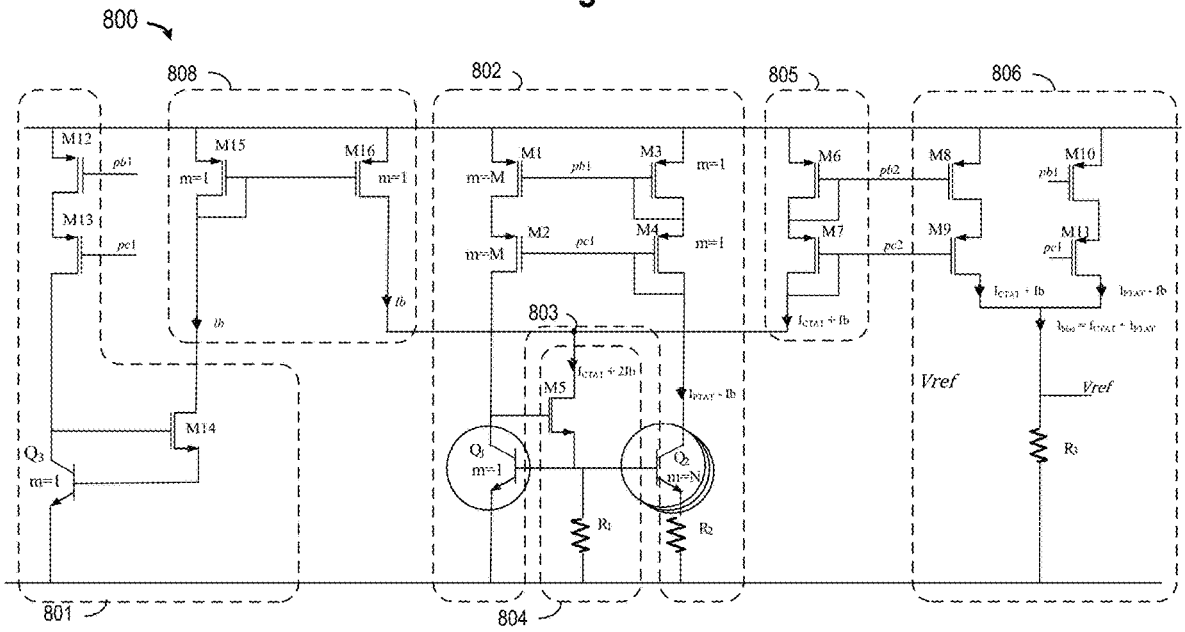
FIG. 8 is a schematic circuit depiction of a fourth bandgap reference circuit with a current mirror for the base current compensation circuit in accordance with selected embodiments of the present disclosure.

To further improve the accuracy of the bandgap reference voltage and current in light of the present disclosure, reference is now made to FIG. 8 which is a schematic circuit depiction of a fourth bandgap reference circuit 800 in accordance with an alternate embodiment to the present disclosure. Similar to the bandgap reference circuit 200 shown in FIG. 2, the fourth bandgap reference circuit 800 includes a first current generator block (or circuit) 802 for generating a PTAT current, a second current generator block (or circuit) 804 for generating a CTAT current, a third current mirror block (or circuit) 805 for generating a copy of the CTAT current, and a fourth current summing block (or circuit) 806 for generating the reference current ($i_{BIAS}$) by combining the PTAT and CTAT currents. In addition, the fourth bandgap reference circuit 800 includes a base current compensation circuit 801 and a current mirror circuit 808. As depicted, the base current compensation circuit 801 includes FET transistors M12-M14 and bipolar transistor Q3 connected as shown to form an additional current branch which creates a compensation base current (Ib) which is combined at node 803 with the CTAT current ($I_{CTAT}$+Ib). In particular, the base current compensation circuit 801 includes FET transistors M12-M13 connected in series to the additional bipolar transistor Q3 which has FET transistor M14 connected across the collector and base, with the transistors M12 and M13 having gates controlled by the gate control signals pb1, pc1. In addition, the current mirror circuit 808 includes additional FET transistors M14, M15 which are connected to mirror the base current Ib.

In the fourth bandgap reference circuit 800, the current mirror circuit 808 is added to the base current compensation circuitry 801. By way of explanation, reference is made to the second bandgap reference circuit 600 shown in FIG. 6 where the base current compensation circuit 601 is used to remove the base current Ib from the current $I_{CTAT}$+$I_{PTAT}$+Ib on the reference voltage Vref output pin. As a result, if the fourth current summing circuit 806 were only adding copies of $I_{CTAT}$+2Ib and $I_{PTAT}$−Ib to generate the reference current Ibias, there would still be an error of Ib on the current reference. Accordingly, the current mirror circuit 808 effectively removes this remnant base current error Ib from the reference current Ibias generated by the fourth current summing circuit 806.

In accordance with selected embodiments, the bandgap reference circuit 800 can be used to generate a very accurate bandgap reference voltage by trimming the first resistor R1 which will change the CTAT current generated by the second current generator circuit 804, thereby trimming the temperature coefficient (TC) on the bandgap voltage reference Vref. In addition, the absolute value could be easily trimmed by trimming the output resistor R3 that generates the bandgap voltage reference Vref.

Figure 9:
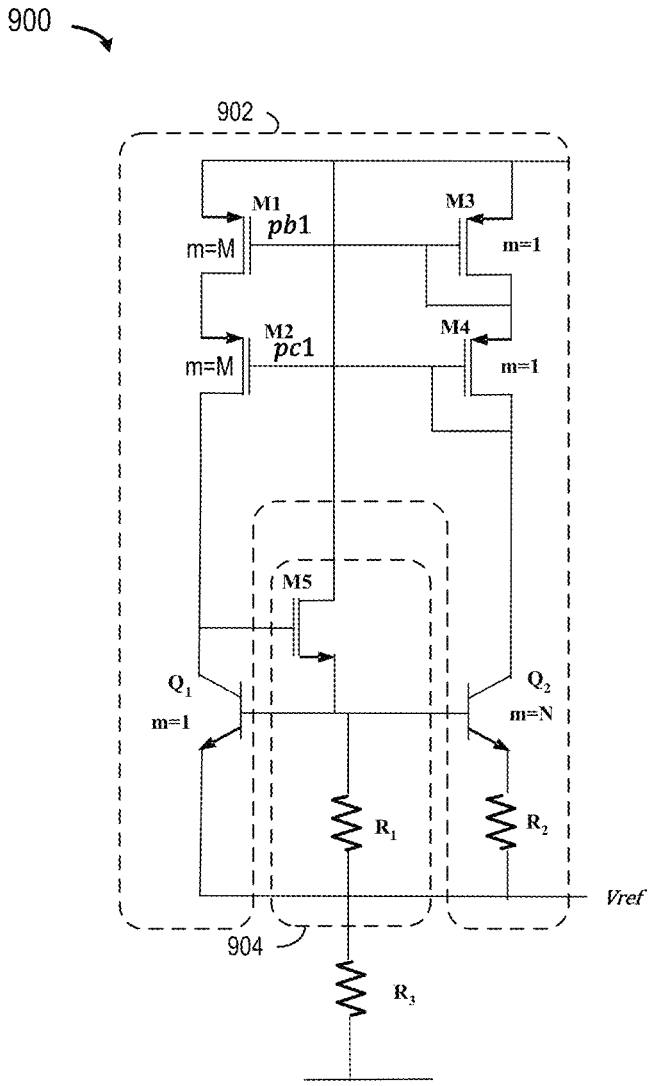
FIG. 9 is a schematic circuit depiction of a fifth band gap reference voltage circuit in accordance with selected embodiments of the present disclosure.

To provide additional details for an improved understanding of selected embodiments of the present disclosure, reference is now made to FIG. 9 which is a schematic circuit depiction of a fifth band gap reference voltage circuit 900 in accordance with an alternate embodiment to the present disclosure. Similar to the bandgap reference circuit 200 shown in FIG. 2, the fifth bandgap reference circuit 900 includes a first current generator block (or circuit) 902 and a second current generator block (or circuit) 904, but without also requiring a third current mirror block (or circuit) or fourth current summing block (or circuit). The first circuit 902 includes FET transistors M1-M4, bipolar transistors Q1-Q2, and resistor R2 connected as shown to generate a first PTAT current across the resistor R2. The second circuit 904 includes FET transistor M5 and resistor R1 connected as shown to generate a second CTAT current across the resistor R1. However, instead of connecting the second circuit 204 between the third current mirror circuit 205 and ground (as shown in FIG. 2), the second circuit M5/R1 904 is connected between the supply voltage (via the drain of FET transistors M5) and an output transistor R3 which in turn is connected to ground. As connected, the first and second circuits 902, 904 form a first circuit branch M1/M2/Q1, a second circuit branch M3/M4/Q2/R2, and a third circuit branch M5/R1, where the transistors M1/M3 and M2/M4 have their gates shared and annotated pb1, pc1, respectively. Instead of using a separate output branch summation circuit, the combines the currents from the fourth and fifth circuit branches M8/M9, M10/M11 to generate the reference current (Ibias) and reference voltage (Vref) across the output transistor R3. With fewer circuit branches, the fifth band gap reference voltage circuit 900 provides the same accuracy performance with less current consumption than the bandgap reference circuit 200 shown in FIG. 2, albeit at the expense of requiring a higher power supply voltage (e.g. 2V).

As disclosed herein, selected embodiments of the disclosed bandgap reference circuit may provide several enhancements when compared with conventional bandgap reference circuits. In addition to providing temperature stability in a bandgap reference circuit that can operate with lower power supplies, the disclosed bandgap reference circuit includes CTAT current generator/mirror circuits that do not include an additional bipolar transistor which increase die size and introduce mismatch errors. In addition, the PTAT and CTAT currents summed in the current summing circuit of the disclosed bandgap reference circuit do not include error-inducing remnant base current components since the base current compensation circuit and current mirror circuit effectively filter out the base current Ib. In addition, the disclosed bandgap reference circuit generates both a bandgap reference voltage and current with an optimized number of components and circuit branches to generate a low reference voltage output with reduced current consumption that is suitable for low power consumption circuits, such as sleep mode bandgap circuits.

By now it should be appreciated that there has been provided a low voltage bandgap reference architecture, circuit, method, and system for generating a low voltage bandgap reference voltage and/or current. In the disclosed embodiments, the bandgap reference circuit includes a first current generator which includes first and second circuit branches respectively comprising first and second bipolar transistors having different sizing reference values for generating a first current at a first resistor in response to a reference voltage, wherein said first current varies proportionally as a function of temperature. In selected embodiments, the first bipolar transistor comprises one bipolar transistor having a sizing reference of m, and the second bipolar transistor comprises eight bipolar transistors connected in parallel, each of eight bipolar transistors having a having a sizing reference of m. In addition, the bandgap reference circuit includes a second current generator which includes a third circuit branch having one or more field effect transistors and no bipolar transistors for generating a second current to counteract for the variation of said first current, wherein said second current varies inversely as a function of temperature. For example, the first current may be a proportional to absolute temperature (PTAT) current, and the second current may be a complementary to absolute temperature (CTAT) current. The bandgap reference circuit also includes a third circuit configured and connected to generate a bandgap reference current in response to the first current and the second current. In selected embodiments, the third circuit includes a resistor connecting between a ground reference and a common node connecting the first, second, and third circuit branches. In other embodiments, the third circuit includes an output branch summation circuit having a fourth circuit branch and fifth circuit branch for respectively mirroring the first current and second current, where the output branch summation circuit combines the currents from the fourth and fifth circuit branches to generate the bandgap reference current (Ibias) and a bandgap reference voltage (Vref) at an output node. In selected embodiments, the bandgap reference circuit also includes a fourth circuit connected to remove a base current component from the bandgap reference current. In other embodiments, the bandgap reference circuit also includes a mirror circuit connected to mirror the second current for input to the third circuit.

In another form, there is provided a low voltage bandgap reference architecture, circuit, method, and system for generating a bandgap reference voltage and/or current. In the disclosed embodiments, a first current is generated that varies proportionally as a function of temperature in response to a supply reference voltage by using a first current generator which includes first and second circuit branches respectively having first and second bipolar transistors having different sizing reference values. In addition, a second current is generated that varies inversely as a function of temperature by using a second current generator which includes a third circuit branch having one or more field effect transistors and no bipolar transistors. In addition, a bandgap reference current is generated in response to the first and second currents by using a third circuit connected to the first and second current generators. In selected embodiments, the bandgap reference current is generated by supplying the first and second currents to a shared resistor connected between a ground reference voltage and a common node connecting the first, second, and third circuit branches. In other embodiments, the bandgap reference current is generated by mirroring the first and second currents at a fourth circuit branch and fifth circuit branch, respectively, of an output branch summation circuit which combines the currents from the fourth and fifth circuit branches to generate the bandgap reference current. In still other embodiments, a bandgap reference voltage is generated by supplying the bandgap reference current to an external resistor connected between the output branch summation circuit and a ground reference. In such embodiments, the generated bandgap reference voltage is 1V or less. In addition, the disclosed embodiments may include removing a base current component from the bandgap reference current with a fourth circuit comprising a sixth circuit branch connected between the supply reference voltage and a ground reference voltage. In such embodiments, the removal of the base current component may include mirroring a base current component for input to the third circuit.

In yet another form, there is provided a bandgap architecture, circuit, method, and system for generating a bandgap reference voltage and/or current. In the disclosed bandgap circuit, a first current path includes a first MOS transistor, a second MOS transistor, and a first bipolar transistor having a first reference size coupled in series with each other between a first reference supply node and a first shared node. The disclosed bandgap circuit also includes a second current path which includes a third MOS transistor, a fourth MOS transistor, a second bipolar transistor having a second reference size, and first resistor coupled in series with each other between the first reference supply node and the first shared node, thereby generating a first current at the first resistor that varies proportionally as a function of temperature. In selected embodiments, the first bipolar transistor is formed with one bipolar transistor having a sizing reference of m, and the second bipolar transistor is formed with eight bipolar transistors connected in parallel, each of eight bipolar transistors having a having a sizing reference of m, for a total of nine bipolar transistors. In addition, the disclosed bandgap circuit includes a third current path which includes a fifth MOS transistor and a second resistor coupled in series with each other and without a bipolar transistor between the first reference supply node and the first shared node, thereby generating a second current at the second resistor that varies inversely as a function of temperature. Finally, the bandgap circuit includes an output branch summation circuit which includes one or more circuit components coupled between the first reference supply node and a second reference supply node, thereby generating generate a bandgap reference current in response to the first current and the second current. In selected embodiments, the output branch circuit includes a fourth current path (having a sixth MOS transistor and seventh MOS transistor coupled in series with each other between the first reference supply node and a bandgap voltage output node), a fifth current path (having an eighth MOS transistor and ninth MOS transistor coupled in series with each other between the first reference supply node and the bandgap voltage output node), and an output resistor connected between the bandgap voltage output node and the second reference supply node to receive the bandgap reference current and to generate therefrom the bandgap reference voltage at the bandgap voltage output node. In other embodiments, the output branch circuit includes an output resistor connected between the first shared node and the second reference supply node to receive the bandgap reference current and to generate therefrom the bandgap reference voltage. Selected embodiments of the disclosed bandgap circuit also include an output resistor coupled to receive the bandgap reference current and to generate therefrom a bandgap reference voltage that is substantially 1V or less.

Although the described exemplary embodiments disclosed herein focus on example bandgap reference voltage circuits, systems, and methods for using same, the present invention is not necessarily limited to the example embodiments illustrate herein. For example, various embodiments of a bandgap reference circuit may use additional or fewer circuit components than those specifically set forth. Thus, the particular embodiments disclosed above are illustrative only and should not be taken as limitations upon the present invention, as the invention may be modified and practiced in different but equivalent manners apparent to those skilled in the art having the benefit of the teachings herein. Accordingly, the foregoing description is not intended to limit the invention to the particular form set forth, but on the contrary, is intended to cover such alternatives, modifications and equivalents as may be included within the spirit and scope of the invention as defined by the appended claims so that those skilled in the art should understand that they can make various changes, substitutions and alterations without departing from the spirit and scope of the invention in its broadest form.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A low voltage bandgap reference circuit comprising:

a first current generator comprising first and second circuit branches respectively comprising first and second bipolar transistors having different sizing reference values for generating a first current at a first resistor in response to a reference voltage, wherein said first current varies proportionally as a function of temperature;

a second current generator comprising a third circuit branch comprising one or more field effect transistors and no bipolar transistors for generating a second current to counteract for the variation of said first current, wherein said second current varies inversely as a function of temperature; and a third circuit configured to generate a bandgap reference current in response to the first current and the second current, wherein the third circuit comprises a resistor connected between a ground reference and a common node directly connected to the first, second, and third circuit branches.

2. The low voltage bandgap reference circuit of claim 1, wherein said first current is a proportional to absolute temperature (PTAT) current.

3. The low voltage bandgap reference circuit of claim 1, wherein said second current is a complementary to absolute temperature (CTAT) current.

4. The low voltage bandgap reference circuit of claim 1, wherein the first bipolar transistor comprises one bipolar transistor having a first sizing reference, and where the second bipolar transistor comprises eight bipolar transistors connected in parallel, each of eight bipolar transistors having the first sizing reference.

5. A method for generating a bandgap reference current, comprising:

generating a first current that varies proportionally as a function of temperature in response to a supply reference voltage with a first current generator comprising first and second circuit branches respectively comprising first and second bipolar transistors having different sizing reference values;

generating a second current that varies inversely as a function of temperature with a second current generator comprising a third circuit branch comprising one or more field effect transistors and no bipolar transistors; and generating the bandgap reference current by supplying the first and second currents to a shared resistor connected between a ground reference voltage and a common node directly connected to the first, second, and third circuit branches.

6. The method of claim 5, further comprising generating a bandgap reference voltage by supplying the bandgap reference current to the shared resistor connected between the ground reference voltage and the common node directly connected to the first, second, and third circuit branches.

7. The method of claim 6, wherein the bandgap reference voltage is 1V or less.

8. A bandgap circuit, comprising:

a first current generator for generating a first current, comprising:

a first circuit branch comprising a first MOS transistor, a second MOS transistor, and a first bipolar transistor having a first reference size coupled in series with each other between a first reference supply node and a first shared node; and a second circuit branch comprising a third MOS transistor, a fourth MOS transistor, a second bipolar transistor having a second reference size, and a first resistor coupled in series with each other between the first reference supply node and the first shared node, thereby generating the first current at the first resistor that varies proportionally as a function of temperature;

a second current generator for generating a second current, comprising a third circuit branch comprising a fifth MOS transistor and a second resistor coupled in series with each other and without a bipolar transistor between the first reference supply node and the first shared node, thereby generating the second current at the second resistor that varies inversely as a function of temperature; and a third circuit connected to receive the first current and the second current and to generate a bandgap reference current in response to the first current and the second current, wherein the third circuit comprises a shared resistor connecting between a ground reference and a common node directly connected to the first, second, and third circuit branches.

9. The bandgap circuit of claim 8, wherein the first bipolar transistor comprises one bipolar transistor having a first sizing reference, and where the second bipolar transistor comprises eight bipolar transistors connected in parallel, each of eight bipolar transistors having the first sizing reference.

10. The bandgap circuit of claim 8, wherein the shared resistor is coupled to receive the bandgap reference current and to generate therefrom a bandgap reference voltage that is substantially 1V or less.

* * * * *